United States Patent [19]

Russel

[11] Patent Number: 4,537,493

[45] Date of Patent: Aug. 27, 1985

[54] COPY SHEET POSITIONING APPARATUS

[75] Inventor: Matthew J. Russel, Rochester, N.Y.

[73] Assignee: Eastman Kodak Company, Rochester, N.Y.

[21] Appl. No.: 575,966

[22] Filed: Feb. 1, 1984

[51] Int. Cl.[3] ..... G03G 15/00

[52] U.S. Cl. ..... 355/3 SH; 355/3 TR; 355/4

[58] Field of Search ..... 355/4, 3 TR, 14 TR, 355/3 SH, 14 SH

[56] References Cited

U.S. PATENT DOCUMENTS

| | | | |
|---|---|---|---|
| 3,409,366 | 11/1968 | Hanson et al. | 355/102 |
| 3,690,756 | 9/1972 | Smith | 355/4 |
| 4,080,055 | 3/1978 | Gary | 355/102 |
| 4,251,154 | 2/1981 | Russel | 355/14 TR |

*Primary Examiner*—A. T. Grimley
*Assistant Examiner*—David Warren
*Attorney, Agent, or Firm*—Donald D. Schaper

[57] ABSTRACT

Copy sheet positioning apparatus is provided in electrographic apparatus which produces copies of at least first and second dimensions and which includes a movable image transfer member upon which transferable unfixed images are formed. The copy sheet positioning apparatus includes a first sheet handling assembly located adjacent to the image transfer member which defines a first path for a copy sheet of a first dimension. The first sheet handling assembly is operative to remove and reposition such a copy sheet with respect to the image transfer member. The copy sheet positioning apparatus also includes a second sheet handling assembly which defines with the first sheet handling assembly a second path for a copy sheet of a second dimension. The second sheet handling assembly cooperates with the first sheet handling assembly to remove and reposition such a copy sheet with respect to the image transfer member.

5 Claims, 7 Drawing Figures

FIG. 2
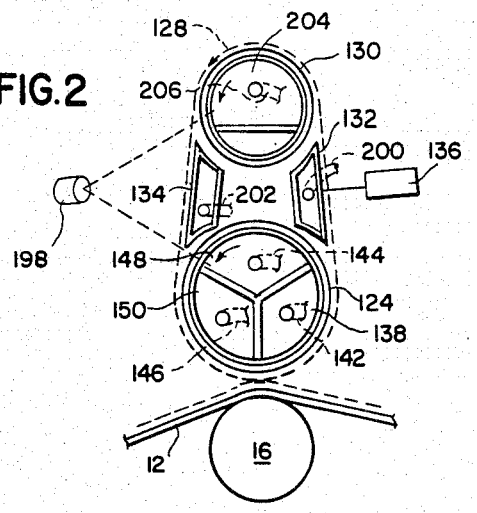
FIG. 3
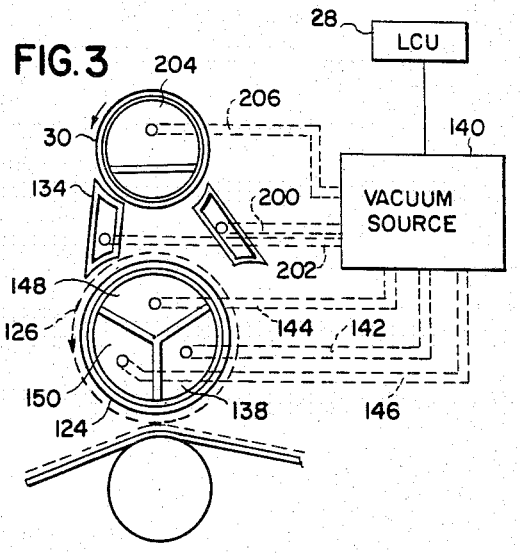
FIG. 4a
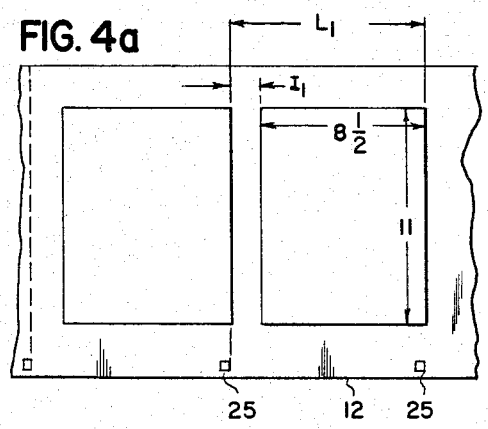
FIG. 4b
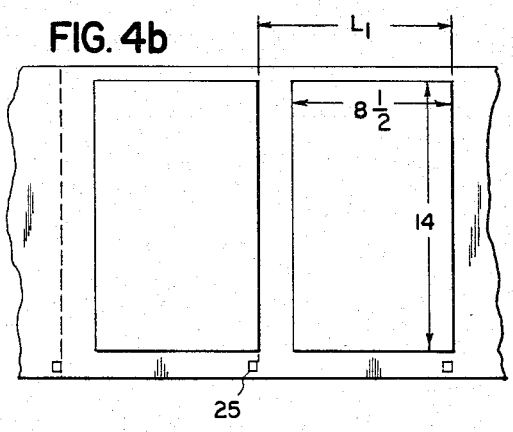
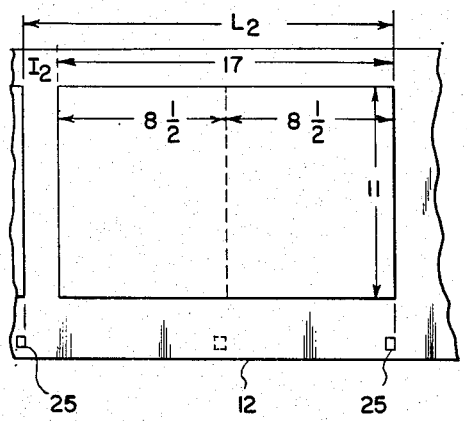
FIG. 4c
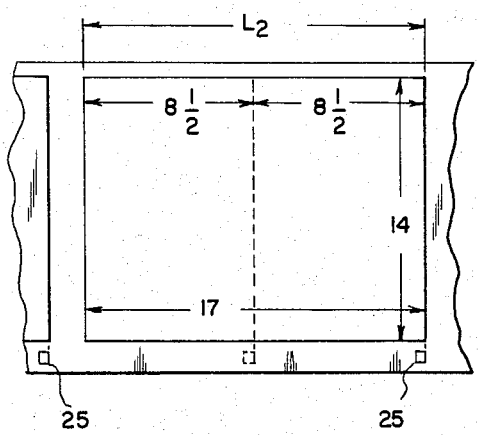
FIG. 4d

COPY SHEET POSITIONING APPARATUS

BACKGROUND OF THE INVENTION

This invention relates generally to electrographic apparatus and more particularly this invention relates to electrographic apparatus which produces copies of at least first and second dimensions.

Many techniques have been proposed for producing copies in which a plurality of images are produced on a single sheet. In one such technique, color separation images of an original are superimposed upon a sheet to produce a color copy of the original. An electrographic apparatus for producing colored copies is described and illustrated in commonly assigned U.S. Pat. No. 4,251,154, issued Feb. 17, 1981, for "Electrophotographic Color Copier," by M. J. Russel. The described apparatus includes a movable image transfer member for receiving related transferable color separation images in non-overlapping image areas. The image transfer member is moved along a transport path and a transfer mechanism is mounted adjacent to the transport path for transferring at spaced locations along the path the color separation images to a receiver sheet. The transfer mechanism successively positions the receiver sheet at the spaced locations in register with and in image transfer relation to the color separation images on the moving transfer member to superimpose the color separation images in register on the receiver sheet. Although the disclosed apparatus may be suitable for the purposes for which it was intended, the apparatus is limited to producing copies of a single dimension as measured in the direction of movement of the image transfer member. A receiver sheet is removed from the image transfer member and positioned in contact with the transfer member in registration with a successive image on the transfer member by means of a fixed dimension register roller which has a circumference equal to the dimension of one image area in the direction of travel of the image transfer member plus the distance between adjacent areas. Thus, for example, if letter size copies ($8\frac{1}{2}\times 11$ inches) and legal size copies ($8\frac{1}{2}\times 14$ inches) are produced, the circumference of the register roller is equal to $8\frac{1}{2}$ inches plus an interframe distance of approximately $1\frac{1}{2}$ inches or a total of 10 inches.

If it is desired to produce copies of greater dimension, for example, $11\times 17$ copies, then both the circumference of the register rollers and the image area on the image transfer member would have to be increased in size. However, if it were desirable to produce both $8\frac{1}{2}\times 11$ and $11\times 17$ inch copies with the larger sized apparatus, then certain inefficiencies in operation of such an apparatus would result. Thus, if such an apparatus were switched from producing larger copies to smaller copies, the register roller must be accelerated to reposition the copy sheet in time for the $8\frac{1}{2}\times 11$ image. This change in roller velocity results in increased power requirements for the registration roller drive, in registration inaccuracies, and in mechanical difficulties such as vibration. Alternatively, if the register roller is not accelerated, an $8\frac{1}{2}\times 11$ image produced after an $11\times 17$ image must be delayed on the image transfer member, thus creating an unusually large interframe distance. This results in decreased productivity since the maximum productivity would be limited to the number of large frames imaged per hour.

Thus, it would be desirable to provide an electrographic apparatus which not only produces multiple images on a single copy but also which efficiently produces copies of different dimensions.

SUMMARY OF THE INVENTION

According to the present invention, copy sheet positioning apparatus is provided in electrographic apparatus which produces copies of at least first and second dimensions and which includes a movable image transfer member upon which transferable unfixed images are formed. The copy sheet positioning apparatus includes a first sheet handling means located adjacent to the image transfer member for defining a first path for a copy sheet of said first dimension. The first sheet handling means is operative to remove a copy sheet of said first dimension from transferable relationship with said image transfer member after transfer of one unfixed image to said sheet and to reposition said copy sheet in transferable relationship with a successive unfixed image on said image transfer member wherein said removing and positioning is effected without contacting the first unfixed image on the copy sheet.

The copy sheet positioning apparatus also includes second sheet handling means for defining with said first sheet handling means a second path for a copy sheet of said second dimension. The second sheet handling means cooperates with said first sheet handling means to remove a copy sheet of said second dimension from transferable relationship with said image transfer member after transfer of one unfixed image to said copy sheet and to reposition said copy sheet in transferable relationship with a successive unfixed image on said image transfer member wherein said removing and repositioning is effected without contacting said first unfixed image on said copy sheet.

The invention and its objects and advantages will become more apparent in the detailed description of the preferred embodiment presented below.

BRIEF DESCRIPTION OF THE DRAWINGS

In the detailed description of the preferred embodiments of the invention, reference is made to the accompanying drawing like numbers indicating like elements in which.

FIGS. 2 and 3 are partially sectional elevational views of the sheet positioning apparatus of FIG. 1 respectively illustrating the removal and repositioning of sheets of first and second dimensions; and FIGS. 4A–4D are diagrammatic views of different dimensioned image areas on the photoconductive member of the electrographic apparatus of FIG. 1.

DESCRIPTION OF THE PREFERRED EMBODIMENTS

Figure 1:
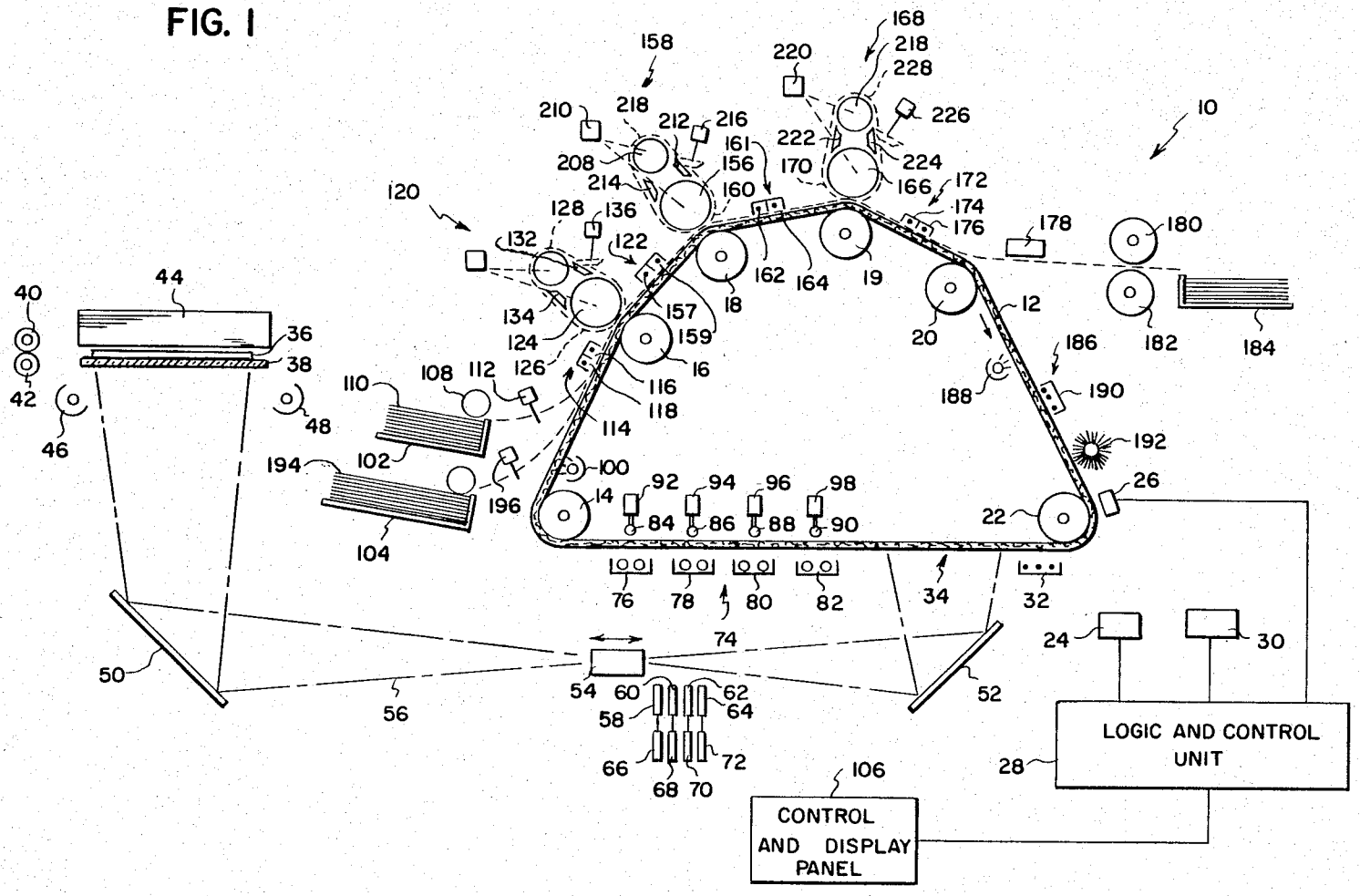
FIG. 1 is a schematic representation of electrographic apparatus including the copy sheet positioning apparatus of the present invention.

As shown in FIG. 1, there is schematically illustrated electrographic apparatus in which a preferred embodiment of sheet positioning apparatus according to the present invention is incorporated. The electrographic apparatus is operable to produce copies of different dimensions in which a plurality of superimposed images are formed on a copy. As shown, electrographic apparatus 10 includes a flexible image transfer member or photoconductive belt 12 trained about rollers 14, 16, 18, 19, 20, and 22. Belt 12 is moved in a clockwise direction by means of a drive motor 24 which is linked to roller 22. Belt 12 has a plurality of sequentially spaced non-overlapping image areas which pass successively through a series of electrophotographic processing stations located along the path of belt 12. Belt 12 preferably includes timing marks such as regularly spaced perforations 25 (FIG. 4A) which are sensed by sensor 26 to provide timing signals to logic and control unit 28. Logic and control unit 28 includes a microprocessor such as model 8085 available from the Intel Corporation of California. An encoder 30 is also linked to roller 22 and produces timing signals for LCU 28 which are used with the timing signals from sensor 26 to control the operation of electrographic apparatus 10.

Transferable images are formed on belt 12 through the steps of charging, exposing, and developing. As shown in FIG. 1, a corona charger 32 applies a substantially uniform electrostatic charge on belt 12. At exposure station 34 a light image of an original image is projected onto the charged belt to discharge those areas struck by light to form a latent electrostatic image corresponding to the original image. In apparatus 10, related color separation latent electrostatic images are formed sequentially and in spaced relation on belt 12 by exposing an original 36 moved onto transparent platen 38 by means of feed rollers 40 and 42 or recirculating document feeder 44.

Where a four-color original is to be reproduced, four sequential latent electrostatic images are formed on belt 12 by successively illuminating document 36 by means of xenon flash lamps 46 and 48 to produce light images which are projected upon belt 12 at exposure station 34 by means of mirrors 50 and 52 and projection optics 54. Projection optics 54 are movable in order to permit enlarged or reduced images of the original document 36. The document 36, for example, is illuminated four successive times to produce four related latent electrostatic separation images by successively inserting into light path 56, neutral density filter 58, red filter 60, green filter 62, and blue filter 64. Filters 58, 60, 62, and 64 are sequentially activated by solenoids 66, 68, 70, and 72 respectively, which are selectively actuated by LCU 28. Thus, latent electrostatic images corresponding to black, red, green and blue separation images are sequentially formed on belt 12 to be developed at developer station 74.

Development station 74 has a plurality of magnetic brush toning stations which are adjacent to but spaced from the path of belt 12. Thus, for four-color reproduction four magnetic brush toning stations are provided. Developer station 74 includes (1) black station 76 containing black toner particles to develop the black electrostatic latent image, (2) cyan toning station 78 containing cyan toner particles which are complementary in color to develop the red electrostatic latent image; (3) magenta toning station 80 containing magenta toner particles which are complementary in color to develop the green electrostatic latent image; and (4) yellow toning station 82 containing yellow toner particles which are complementary in color to develop the blue electrostatic latent image. Backup rollers 84, 86, 88, and 90 are located on the opposite side of belt 12 and are selectively activated by solenoids 92, 94, 96, and 98 through control of LCU 28.

When one of rollers 84, 86, 88, and 90 is moved into contact with belt 12, belt 12 is deflected from its normal path into operative enegagement with a respective magnetic brush so that charged toner particles of the engaged magnetic brush are attracted to the oppositely charged latent electrostatic image to develop the latent image into a transferable unfixed toner image. Thus, as the black electrostatic latent image approaches developer station 76, LCU 28 actuates solenoid 92 to move roller 84 to deflect belt 12 so that the black image is developed by black toner particles brought up into contact with belt 12 by magnetic brush toning station 76. As soon as the black separation image leaves the area of station 76, solenoid 92 retracts roller 84 so that belt 12 returns to its non-deflected path. Similar operating cycles for stations 78, 80, and 82 are effected, so that the red latent electrostatic image is developed only with cyan toner particles, the green latent electrostatic image is developed only with magenta toner particles and the blue latent electrostatic image is developed only with yellow toner particles.

After the developed toner images leave developer station 74, belt 12 is irradiated by post-development erase lamp 100 to reduce the electrostatic attraction between the toner image and the photoconductive belt.

In one mode, apparatus 10 is operable to produce copies of standard office sizes such as $8\frac{1}{2}\times 11$ inches and $8\frac{1}{2}\times 14$ inches so that the short dimension, for example, $8\frac{1}{2}$ inches, is oriented in the direction of belt movement in order to increase productivity. Belt 12 has a width which is sufficient to contain an image of the longest copy to be produced. Thus, if 14-inch copy is the longest copy produced, belt 12 has a width of approximately 16 inches and would contain a series of non-overlapping image frames each having a first dimension of $L_1$ (FIGS. 4A, 4B) in the direction of movement of belt 12. $L_1$ is the sum of the image width plus an interframe distance between copies; e.g., for an image width of $8\frac{1}{2}$ inches and an interframe distance of $1\frac{1}{2}$ inches, $L_1$ equals 10 inches. The length of belt 12 is equal to the number of image frames times $L_1$; e.g., a six-frame belt would have a 60-inch length.

In a second mode, apparatus 10 is operable to produce copies having widths of double the normal copy width such as used in books and magazines. This mode is illustrated in FIGS. 4C and 4D where belt 12 is divided into a series of image frames having a second dimension $L_2$ which is large enough to produce copies of double copy size such as 17 by 11 inches (FIG. 4C) and 17 by 14 inches (FIG. 4D) with an interframe distance $I_2$ of 3 inches. Thus, the image frame for the larger copies is double the size of the image frame for the smaller copies; i.e., instead of six image frames, belt 12 would have three image frames. In the second mode, LCU 28 is programmed to skip every second perforation 25 on belt 12 to control operation of apparatus 10.

Apparatus 10 is provided with a frist supply 102 of copy sheets of a first dimension such as $8\frac{1}{2}\times$ 11 and a second supply 104 of copy sheets of a second dimension such as $17\times 11$. An operator-selectable sheet size switch on control and display panel 106 provides a signal to logic and control unit 28 to feed either a copy sheet of the first dimension from tray 102 or copy sheet of a second dimension from supply 104. For purposes of illustration, it will be assumed that the operator has pressed a switch on panel 106 to produce copy sheets of $8\frac{1}{2}\times 11$ size. In such case, a vacuum feed roller 108 will separate a sheet 110 from supply 102 and move it into engagement with registration mechanism 112. Mechanism 112 releases the copy sheet in timed relationship with the first toner image on belt 12 in advance of transfer station 114 which includes transfer charger 118 and detack charger 116. As the copy sheet passes under charger 118, a charge opposite to the charge of the toner image is applied to the back of sheet 110 to transfer the first (black) electrostatic image from belt 12 to one side of sheet 110. Sheet 110 and belt 12 then move under detack corona charger 116 which neutralizes the charge on sheet 110 so that it may be easily separated from belt 12.

In order to register copy sheet 110 with the second (cyan) toner image on belt 12, the sheet bearing the black toner image is removed from transferable relationship with belt 12 and is repositioned in transferable relationship with the next successive toner image on belt 12. In order to effect removal and repositioning, according to the present invention, there are provided a plurality of copy sheet positioning apparatus spaced along belt 12 between transfer stations. Thus, copy sheet positioning apparatus 120 according to the present invention is located adjacent to belt 12 opposite roller 16 between transfer stations 114 and 122; copy sheet positioning apparatus 158 is located adjacent to belt 12 opposite roller 18 between transfer stations 122 and 161; and copy sheet positioning apparatus 168 is located adjacent to belt 12 opposite roller 19 between transfer stations 161 and 172. Copy sheet positioning apparatus 120, 158 and 168 are similar in construction and operation.

Copy sheet handling apparatus 120 includes a first sheet handling assembly for defining a first path for a copy sheet of a first dimension and a second copy sheet handling assembly operating cooperatively with the first sheet handling assembly for defining a second sheet path for a copy sheet of a second dimension. In the copy sheet positioning apparatus 120, first sheet handling assembly includes a vacuum roller 124 spaced from belt 12 which is dimensioned to have a circumference equal to the length of image frame $L_1$ and which defines a first path 126 around the periphery of roller 124. A second copy sheet path 128 has a length equal to the dimension of image frame $L_2$ and comprises a second copy sheet handling assembly including vacuum roller 130 and movable plenum 132 and fixed plenum 134 located between vacuum rollers 124 and 130. When a copy sheet 110 of the first dimension is processed, plenum 132 is moved by solenoid 136 to an open position out of intersection with first path 126 (FIG. 3).

As illustrated in greater detail in FIG. 3, when the leading edge of copy sheet 110 is positioned immediately adjacent to vacuum roller 124, it is tacked to roller 124 by means of a vacuum applied to plenum 138 of roller 124 from vacuum source 140 over conduit 142. As roller 124 rotates, vacuum applied from source 140 over lines 144 and 146 to plenums 148 and 150, respectively, move sheet 110 around first path 126 so that it is repositioned in transferable relationship with the next (cyan) toner image on belt 12. Sheet 110 is then detacked from roller 124 by interrupting the vacuum applied to plenums 138.

Sheet 110 then travels along with belt 12 to second transfer station 122 where second corona transfer charger 157 transfers the cyan toner image to sheet 110 in registration with the previously transferred black toner image. Second detack corona charger 159 then neutralizes the charge on sheet 110 so that vacuum roller 156 (which is spaced from belt 12) of second copy sheet handling apparatus 158 can remove sheet 110 from transferable relationship with belt 12 and move it around path 160 back into transferable relationship with the third (magenta) toner image. Copy sheet 110 then moves with belt 12 under a third transfer corona charger 162 which transfers the magenta toner image onto sheet 110 in registration with the previously transferred black and cyan toner images. Detack charger 164 neutralizes the charge on sheet 110 so that sheet 110 may be removed from transferable relationship with belt 12 by means of vacuum roller 166 (spaced from belt 12) of third copy sheet positioning apparatus 168. Roller 166 moves sheet 110 around path 170 and repositions sheet 110 in transferable relationship with the fourth (yellow) and last toner image on belt 12. Sheet 110 then travels with belt 12 to fourth transfer station 172 where fourth transfer corona charger 174 transfers the yellow toner image onto sheet 110 in registration with the black, cyan and magenta toner images. Fourth detack charger 176 neutralizes the charge on sheet 110 so that it is separated from belt 12 at roller 120 and transported by means of vacuum transport 178 into the nip formed by fuser rollers 180 and 182 to fuse the superimposed toner images to sheet 110. Sheet 110 is then fed into output tray 184.

A cleaning station 186 is provided to effect mechanical and electrical cleaning of photoconductive belt 12. Station 186 includes a cleaning assist erase lamp 188 which exposes photoconductive belt 12 to radiation to substantially reduce any charge remaining on belt 12; a cleaning assist charger 190 which impresses an alternating current charge on belt 12 to neutralize the charges on untransferred toner particles; and a brush 192 to remove any residual toner from belt 12 so that belt 12 is ready for another electrophotographic cycle.

When copies of a second dimension are produced by apparatus 10, the charge, expose, and development steps described above will produce a sequence of toner images on image frames $L_2$ of belt 12. A copy sheet 194 of a second dimension (e.g., $17\times11$ inches) is fed from supply 104 to registration mechanism 196 which registers sheet 194 with the first toner image on belt 12. Transfer of the first toner image to sheet 194 is effected by transfer charger 118 and the charge on sheet 194 neutralized by detack charger 116.

Copy sheet positioning apparatus 120 operates to move sheet 194 around second path 128.

Referring to FIG. 2, solenoid 136 has been actuated by LCU 128 to move plenum 132 to a closed position. Stepper motor 198 is linked to rollers 124 and 130 and causes them to rotate in a counterclockwise direction. LCU 28 also causes vacuum source 140 (FIG. 3) to apply a vacuum over conduits 146 and 142 to plenums 138 and 150 of roller 124 but not to plenum 148. Vacuum source 140 also applies vacuum to plenums 132 and 134 respectively over conduits 200 and 202 and to plenum 204 of roller 130 over conduit 206.

After the first toner image has been transferred to copy sheet 194 at transfer station 114, vacuum roller 124 separates sheet 194 from transferable relationship with belt 12 and in association with roller 130 moves it along path 128. When the leading edge of sheet 194 is repositioned in transferable relationship with the second toner image on belt 12, the vacuum in plenum 138 is removed and sheet 194 travels with belt 12 to transfer station 122 where the second image is transferred onto sheet 194. Thereafter, a second copy sheet positioning apparatus 158 (FIG. 1) removes sheet 194 from transferable relationship with belt 12 and repositions it in transferable relationship with the third toner image on belt 12. Apparatus 158 is similar in construction to apparatus 120 and includes first vacuum roller 156, second vacuum roller 208 and vacuum plenums 212 and 214 located between rollers 156 and 208. Roller 208 is operated in synchronism with roller 156 by means of stepper motor 210 linked to rollers 156 and 208 and vacuum plenum 212 and 214 located between rollers 156 and 208. Vacuum plenum 212 has been moved to a closed position by solenoid 216 so that after sheet 194 has been separated from belt 12 by roller 156, it moves along second path 218.

Copy sheet positioning apparatus 158 then repositions sheet 194 in registration with the third toner image on belt 12 which is transferred to sheet 194 at transfer station 161. Thereafter, sheet 194 is removed from transferable relationship with belt 12 at roller 19 by means of third copy sheet positioning apparatus 168 which includes vacuum rollers 166 and 218 rotated in synchronism by stepper motor 220. Apparatus 168 also includes vacuum plenums 222 and 224 located between rollers 166 and 217. Solenoid 226 has moved plenum 224 to its closed position so that when roller 166 has removed sheet 194 from transferable relationship with belt 12 sheet 194 is moved along a second path 228.

Sheet 194 is repositioned in transferable relationship with belt 12 in registration with the fourth toner image thereon. The fourth image is transferred to sheets 194 in superimposed relationship with the first, second, and third toner images at transfer station 172. Thereafter, sheet 194 is separated from belt 12 at roller 20 and transported by means of vacuum transport 178 to the nip of fuser rollers 180 and 182 which permanently fuse the toner images to sheet 194. Sheet 194 is then fed to output tray 184.

The order of color separation image exposure, development, and transfer is selected in order of decreasing influence on sharpness of the reproduced composite image; for example, black, then cyan, then magenta, then yellow. Accordingly, the four transferred images yield a sharp full color reproduction of the original on the copy sheet. The employment of four separate transfer corona charges and three separate copy sheet positioning apparatus interposed between the transfer charges provides for more accurate control of image transfer and superimposed image registration.

Although the present invention has been described above with respect to copy sheets of first and second dimensions, it will be understood that copy sheets of other dimensions may be utilized in the present invention. Moreover, although four toner images have been described as being transferred in superimposed relationship upon a copy sheet, more or less number of superimposed images may be transferred to a copy sheet. In addition, other colors than black, cyan, magenta, and yellow may be used.

The invention has been described in detail with particular reference to a preferred embodiment thereof, but it will be understood that variations and modifications can be effected within the spirit and scope of the invention.

What is claimed is:

1. In electrographic apparatus which produces copies on copy sheets of at least first and second dimensions and which includes a moving image transfer member upon which transferable unfixed images are formed, copy sheet positioning apparatus comprising:

first sheet handling means located adjacent to said image transfer member for defining a first path for a copy sheet of said first dimension, said first sheet handling means operating to remove said copy sheet of said first dimension from transferable relationship with said image transfer member after transfer of one unfixed image to said sheet of said first dimension and to reposition said copy sheet in transferable relationship with a successive unfixed image on said image transfer member wherein said removing and repositioning is effected without contacting said first unfixed image on said copy sheet; and second sheet handling means for defining with said first sheet handling means a second path for a copy sheet of said second dimension, said second sheet handling means cooperating with said first sheet handling means to remove said copy sheet of said second dimension from transferable relationship with said image transfer member after transfer of one unfixed image to said copy sheet and to reposition said copy sheet in transferable relationship with a successive unfixed image on said image transfer member, wherein said removing and repositioning is effected without contacting said first unfixed image on said copy sheet.

2. The apparatus of claim 1 wherein said first and second copy sheet handling means include vacuum assemblies for attracting and holding the copy sheets.

3. The apparatus of claim 1 wherein said first and second copy sheet handling means respectively include first and second endless vacuum members which are movable in synchronism with each other.

4. The apparatus of claim 1 wherein said first sheet handling means includes a first rotatable vacuum roller which is dimensioned to define said first path, and said second sheet handling means includes a second rotatable vacuum roller located in said second path and means for selectively diverting a copy sheet of said second dimension about said second path.

5. The apparatus of claim 4 wherein first and second vacuum plenums are located between said first and second vacuum rollers and define with said rollers said second path, and said diverting means moves said first plenum between a first position intersecting said first path for diverting a copy sheet of said second dimension about said second path and a second position spaced from said first path for allowing a copy sheet of said first dimension to follow said first path.

* * * * *